US007013282B2

(12) United States Patent
Schrocter

(10) Patent No.: US 7,013,282 B2
(45) Date of Patent: Mar. 14, 2006

(54) SYSTEM AND METHOD FOR TEXT-TO-SPEECH PROCESSING IN A PORTABLE DEVICE

(75) Inventor: Horst Juergen Schrocter, New Providence, NJ (US)

(73) Assignee: AT&T Corp., New York, NY (US)

( * ) Notice: Subject to any disclaimer, the term of this patent is extended or adjusted under 35 U.S.C. 154(b) by 29 days.

(21) Appl. No.: 10/742,853

(22) Filed: Dec. 23, 2003

(65) Prior Publication Data

US 2004/0210439 A1 Oct. 21, 2004

Related U.S. Application Data

(60) Provisional application No. 60/463,760, filed on Apr. 18, 2003.

(51) Int. Cl.
*G10L 13/00* (2006.01)

(52) U.S. Cl. ..... 704/270.1; 704/260

(58) Field of Classification Search ..... 704/270.1, 704/275, 260, 258, 270
See application file for complete search history.

(56) References Cited

U.S. PATENT DOCUMENTS

| | | | | |
|---|---|---|---|---|
| 5,673,362 | A * | 9/1997 | Matsumoto | 704/260 |
| 6,246,981 | B1 * | 6/2001 | Papineni et al. | 704/235 |
| 6,366,886 | B1 * | 4/2002 | Dragosh et al. | 704/270.1 |
| 6,510,411 | B1 * | 1/2003 | Norton et al. | 704/254 |
| 6,748,361 | B1 * | 6/2004 | Comerford et al. | 704/275 |
| 2002/0103646 | A1 | 8/2002 | Kochanski et al. | |

OTHER PUBLICATIONS

Juergen Schroeter, "The Fundamentals of Text-to-Speech Synthesis", VoiceXML Forum, vol. 1 Issue 3, Mar. 2001.

* cited by examiner

*Primary Examiner*—Abul K. Azad

(57) ABSTRACT

A system and method for providing high-quality text-to-speech (TTS) output in a low-complexity device is disclosed. TTS output is generated by a TTS system that resides on a high-complexity device. The TTS output is transmitted from the high-complexity device to the low-complexity device for subsequent retrieval and playback.

24 Claims, 2 Drawing Sheets

SYSTEM AND METHOD FOR TEXT-TO-SPEECH PROCESSING IN A PORTABLE DEVICE

The present application claims priority to provisional patent application No. 60/463,760, entitled "System and Method for Text-To-Speech Processing in a Portable Device," filed Apr. 18, 2003, which is incorporated herein by reference in its entirety.

BACKGROUND

1. Field of the Invention

The present invention relates generally to text-to-speech processing and more particularly to text-to-speech processing in a portable device.

2. Introduction

Text-to-speech (TTS) synthesis technology gives machines the ability to convert arbitrary text into audible speech, with the goal of being able to provide textual information to people via voice messages. These voice messages can prove especially useful in applications where audible output is a key form of user feedback in system interaction. These situations arise when the user is unable to appreciate textual output as an effective means of responsive communication. In that regard, it is believed that TTS technology can provide promising benefits when used as a mechanism for communicating to users of handheld portable devices.

Handheld portable device designs are typically driven by the ergonomics of use. For example, the goal of maximizing portability has typically resulted in small form factors with minimal power requirements. These constraints have clearly lead to limitations in the availability of processing power and storage capacity as compared to general-purpose processing systems (e.g., personal computers) that are not similarly constrained.

Limitations in the processing power and storage capacity of handheld portable devices have a direct impact on the ability to provide acceptable TTS output. Currently, these limitations have dictated that only low-quality TTS technology could be used. What is needed therefore is a solution that enables an application of high-quality TTS technology in a manner that accommodates the limitations of current handheld portable devices.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
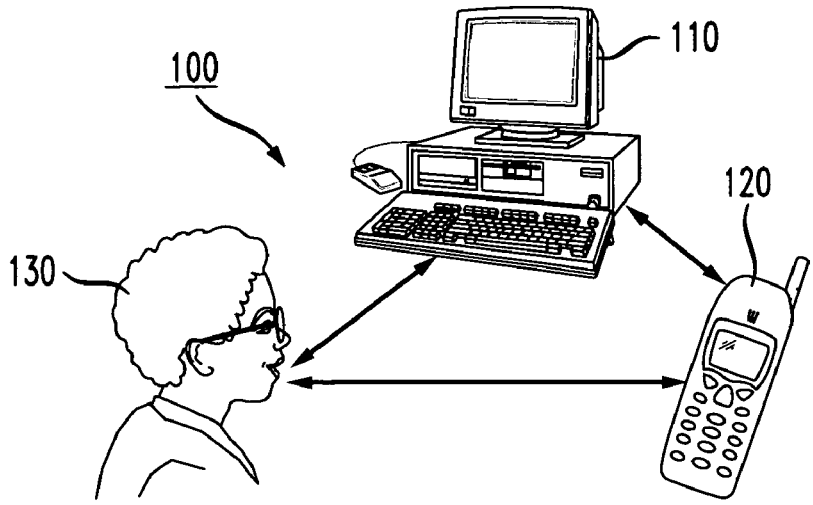
FIG. 1 illustrates an embodiment of a text-to-speech processing environment in accordance with the present invention.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

Text-to-speech (TTS) synthesis technology enables electronic devices to convert a stream of text into audible speech. This audible speech thereby provides users with textual information via voice messages. TTS can be applied in various contexts such as email or any other general textual messaging solution. In particular, TTS is valuable for rendering into synthetic speech any dynamic content, for example, email reading, instant messaging, stock and other alerts or alarms, breaking news, etc.

As would be appreciated, the quality of TTS synthesized speech is of critical importance in the increasingly widespread application of the technology. Portable devices such as mobile phones, personal digital assistants, combination devices such as BlackBerry or Palm devices are particularly suitable for leveraging TTS technology.

Several different TTS methods for synthesizing speech exist, including articulatory synthesis, formant synthesis, and concatenative synthesis methods.

Articulatory synthesis uses computational biomechanical models of speech production, such as models for the glottis (that generates the periodic and aspiration excitation) and the moving vocal tract. Ideally, an articulatory synthesizer would be controlled by simulated muscle actions of the articulators, such as the tongue, the lips, and the glottis. It would solve time-dependent, three-dimensional differential equations to compute the synthetic speech output. Unfortunately, besides having notoriously high computational requirements, articulatory synthesis also, at present, does not result in natural-sounding fluent speech.

Formant synthesis uses a set of rules for controlling a highly simplified source-filter model that assumes that the (glottal) source is completely independent from the filter (the vocal tract). The filter is determined by control parameters such as formant frequencies and bandwidths. Each formant is associated with a particular resonance (a "peak" in the filter characteristic) of the vocal tract. The source generates either stylized glottal or other pulses (for periodic sounds) or noise (for aspiration and frication). Formant synthesis generates highly intelligible, but not completely natural sounding speech. However, it has the advantage of a low memory footprint and only moderate computational requirements.

Finally, concatenative synthesis uses actual snippets of recorded speech that were cut from recordings and stored in an inventory ("voice database"), either as "waveforms" (uncoded), or encoded by a suitable speech coding method. Elementary "units" (i.e., speech segments) are, for example, phones (a vowel or a consonant), or phone-to-phone transitions ("diphones") that encompass the second half of one phone plus the first half of the next phone (e.g., a vowel-to-consonant transition). Some concatenative synthesizers use so-called demi-syllables (i.e., half-syllables; syllable-to-syllable transitions), in effect, applying the "diphone" method to the time scale of syllables. Concatenative synthesis itself then strings together (concatenates) units selected from the voice database, and, after optional decoding, outputs the resulting speech signal. Because concatenative systems use snippets of recorded speech, they have the highest potential for sounding "natural".

Concatenative synthesis techniques also includes unit-selection synthesis. In contrast with earlier concatenative synthesizers, unit-selection synthesis automatically picks the optimal synthesis units (on the fly) from an inventory that can contain thousands of examples of a specific diphone, and concatenates them to produce the synthetic speech.

Conventional applications of TTS technology to low complexity devices (e.g., mobile phones) have been forced to tradeoff quality of the TTS synthesized speech in environments that are limited in its processing and storage capabilities. More specifically, low complexity devices such as mobile devices are typically designed with much lower processing and storage capabilities as compared to high complexity devices such as conventional desktop or laptop personal computing devices. This results in the inclusion of low-quality TTS technology in low complexity devices. For example, conventional applications of TTS technology to mobile devices have used formant synthesis technology, which has a low memory footprint and only moderate computational requirements.

In accordance with the present invention, high-quality TTS technology is enabled even when applied to devices (e.g., mobile devices) that have limited processing and storage capabilities. Principles of the present invention will be described with reference to FIG. 1, which illustrates the application of high-quality TTS technology to a mobile phone 120. In the following description, the high-quality TTS technology is exemplified by concatenative synthesis technology. It should be noted, however, that the principles of the present invention are not limited to concatenative synthesis technology. Rather, the principles of the present invention are intended to apply to any context wherein the TTS technology is of a complexity that cannot practically be applied to a given device.

In one example mobile phone application, TTS technology can be used to assist voice dialing. In general, voice dialing is highly desirable whenever users are unable to direct their attention to a keypad or screen, such as is the case when a user is driving a car. In this scenario, saying "Call John at work" is certainly safer than attempting to dial a 10-digit string of numbers into a miniature dial pad while driving.

Voice dialing and comparable command and control are made possible by automatic speech recognition (ASR) technology that is available in low-footprint ASR engines. The low memory footprint allows ASR to run on the device itself.

While voice dialing can increase personal safety, the voice dialing process is not entirely free from distraction. In some conventional phones, voice dialers provide feedback (e.g., "Do you mean John Doe or John Miller?") via text messages or low-quality TTS.

For high quality (natural-sounding, intelligible) rendering of feedback messages via synthetic speech, the latest TTS technology is needed. Ideally, the TTS module would also run on the device 120 and provide the feedback to the user to ensure that the ASR engine correctly interpreted the voice input. As noted, however, current high-quality TTS requires a greater level of processing and memory support as is available on many current devices. Indeed, it will likely be the case that the most current TTS technology will almost always require a higher level of processing and memory support than is available in many devices.

As will be described in greater detail below, the present invention enables high-quality TTS to be used even in devices that have modest processing and storage capabilities. This feature is enabled through the leveraging of the processing power of additional devices (e.g., desktop and laptop computers) that do possess sufficient levels of processing and storage capabilities. Here, the leveraging process is enabled through the communication between a high-capability device and a low-capability device.

FIG. 1 illustrates an embodiment of such an arrangement. As illustrated in FIG. 1, TTS environment 100 includes high-capability device (e.g., computer) 110, low-capability device (e.g., mobile phone) 120, and user 130. Here, high-capability device 110 and low-capability device 120 can be designed to communicate as part of a synchronization process. This synchronization process allows user 130 to ensure that a database of information (e.g., calendar, contacts/phonebook, etc.) on high-capability device 110 are in sync with the database of information on low-capability device 120. As would be appreciated, modifications to the general database of information (e.g., generating a new contact, modifying existing contact information, etc.) can be made either through the user's interaction with high-capability device 110 or with the user's interaction with low-capability device 120.

It should be noted that the synchronization of information between high-capability device 110 and low-capability device 120 can be implemented in various ways. In various embodiments, wired connections (e.g., USB connection) or wireless connections (e.g., Bluetooth, GPRS, or any other wireless standard) can be used. Various synchronization software can also be used to effect the synchronization process. Current examples of available synchronization software include HotSync by Palm, Inc. and iSync by Apple Computer, Inc. As would be appreciated, the principles of the present invention are not dependent upon the particular choice of connection between high-capability device 110 and low-capability device 120, or the particular synchronization software that coordinates the exchange.

In general, the synchronization process provides a structured manner by which high-quality TTS information can be provided to low-capability device 120. In an alternative embodiment, a dedicated software application can be designed apart from a third-party synchronization software package to accomplish the intended purpose. With this communication conduit, the TTS system in low-capability device 120 can leverage the processing and storage capabilities within high-capability device 110. More specifically, in the context of a concatenative synthesis technique the processing and storage intensive portions of the TTS technology would reside on high-capability device 110. An embodiment of this structure is illustrated in FIG. 2.

Figure 2:
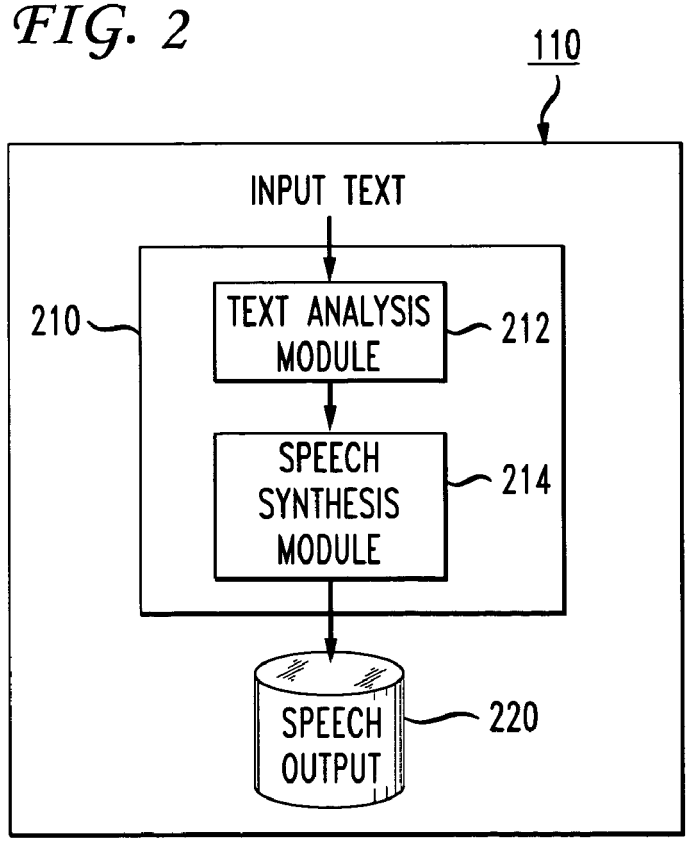
FIG. 2 illustrates an embodiment of a text-to-speech component in a high-capability computing device.

As illustrated in FIG. 2, high-capability device 110 includes TTS system 210. In one embodiment, TTS system 210 is a concatenative synthesis system that includes text analysis module 212 and speech synthesis module 214. Text analysis module 212 itself can include a series of modules with separate and intertwined functions. In one embodiment, text analysis module 212 analyzes input text and converts it to a series of phonetic symbols and prosody (fundamental frequency, duration, and amplitude) targets. While the specific output provided to speech synthesis module 214 can be implementation dependent, the primary function of speech synthesis module is to generate speech output. This speech output is stored in speech output database 220.

The TTS output that is stored in speech output database 220 represents the result of TTS processing that is performed entirely on high-capability device 110. The processing and storage capabilities of low-capability device 120 have thus far not been required.

In one embodiment, TTS system 210 can be used to generate presynthesized speech output for both carrier phrases and slot information. An example of a carrier phrase is "Do you want me to call [slot1] at [slot2] at number [slot3]?" In this example, slot1 can represent a name, slot2 cam represent a location, and slot3 can represent a phone number, yielding a combined output of "Do you want me to call [John Doe] at [work] at number [703-555-1212]?" As this example illustrates, each of the slot elements 1, 2, and 3 represent audio fillers for the carrier phrase. It is a feature of the present invention that both the carrier phrases and the slot information can be presynthesized at high-capability device 110 and downloaded to low-capability device 120 for subsequent playback to the user.

Figure 3:
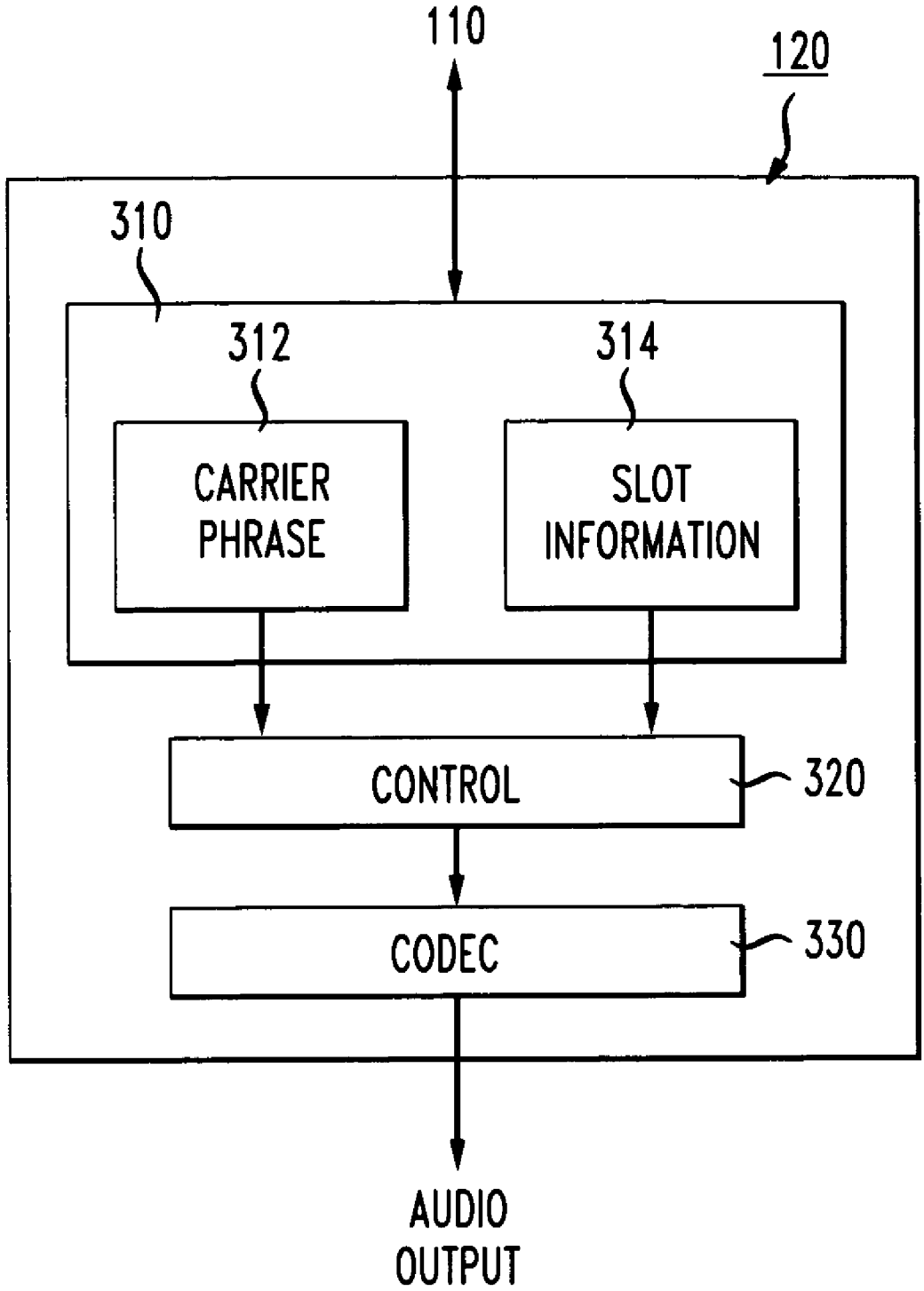
FIG. 3 illustrates an embodiment of a text-to-speech component in a low-capability computing device.

FIG. 3 illustrates an embodiment of low-capability device 120 that supports this framework of presynthesized carrier phrases and slot information. As illustrated, low-capability device 120 includes a memory 310. Memory 310 can be structured to include carrier phrase portion 312 and slot information portion 314. Carrier phrase portion 312 is designed to store presynthesized carrier data, while slot information portion 314 is designed to store presynthesized slot data.

As would be appreciated, the carrier phrases would likely apply to most users and can therefore be preloaded onto low-capability device 120. As such, the presynthesized carrier phrases can be generated by a manufacturer using a high-capability computing device 110 operated by the manufacturer and downloaded to low-capability device 120 during the manufacturing process for storage in carrier phrase portion 312.

Once low-capability device 120 is in possession of the user, customization of low-capability device can proceed. In this process, the user can decide to customize the carrier phrases to work with user-defined slot types. This customization process can be enabled through the presynthesis of custom carrier phrases by a high-capability computing device 110 operated by the user. The presynthesized custom carrier phrases can then be downloaded to low-capability device 120 for storage in carrier phrase portion 312.

In a similar manner to the carrier phrases, the slot information would also be presynthesized by a high-capability computing device 110 operated by the user. In an embodiment that leverages synchronization software, the slot information can be downloaded to low-capability device 120 as another data type of a general database that is updated during the synchronization process. For example, slot information dedicated for names, locations, and numbers can be included as a separate data type for each contact record in a user's address/phone book. As would be appreciated, slot types can be defined for any data type that can represent a variable element in a user record.

The provision of carrier phrases and slot information to low-capability device 120 enables the implementation of a simple TTS component on low-capability device 120. This simple TTS component can be designed to implement a general table management function that is operative to coordinate the storage and retrieval of carrier phrases and slot information. A small code footprint therefore results.

In one embodiment, the presynthesized carrier phrases and slot information are downloaded in coded (compressed) form. While the transmission of compressed information to low-capability device 120 will certainly increase the speed of transfer, it also enables further simplicity in the implementation of the TTS component on low-capability device 120. More specifically, in one embodiment, the TTS component on low-capability device 120 is designed to leverage the speech coder/decoder (codec) that already exist on low-capability device 120. By presynthesizing and storing the speech output in the appropriate coded format used by low-capability device 120, the TTS component can then be designed to pass the retrieved coded carrier and slot information through the existing speech codec of low-capability device 120. This functionality effectively produces TTS playback by "faking" the playback of a received phone call. This embodiment serves to significantly reduce implementation complexity by further minimizing the demands on the TTS component on low-capability device 120.

As illustrated in FIG. 3, this process can be effected by retrieving carrier phrases and slot information from memory portions 312 and 314, respectively, using control element 320. In general, control element 320 is operative to ensure the synchronized retrieval of presynthesized speech segments from memory 310 for production to codec 330. Codec 330 is then operative to produce audible output based on the received presynthesized speech segments.

In one embodiment, the principles of the present invention can also be used to transfer presynthesized speech segments representative of general text content (from high capability device 110 to low-capability device 120. For example, the general text content can include dynamic content such as emails, instant messaging, stock and other alerts or alarms, breaking news, etc. This dynamic content can be presynthesized and transferred to low-capability device 120 for later replay upon command.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A method for synthesizing speech on a portable device, comprising:

(1) receiving presynthesized slot information as part of a synchronization process with a computing device, wherein said slot information represents a value of a defined data type in a user record on said computing device, said slot information being designed for inclusion at a predefined position within a carrier phrase;

(2) storing said presynthesized slot information in a memory; and (3) reproducing said carrier phrase and said presynthesized slot information as audible output for a user.

2. The method of claim 1, wherein said slot information is one of a name, number, and location.

3. The method of claim 1, further comprising receiving a presynthesized carrier phrase.

4. The method of claim 1, wherein said carrier phrase and said presynthesized slot information is compressed and wherein said reproducing comprises passing said carrier phrase and said presynthesized slot information through a codec.

5. The method of claim 1, wherein said receiving comprises receiving via a wired link.

6. The method of claim 1, wherein said receiving comprises receiving via a wireless link.

7. A computing device for synthesizing speech on a portable device, the computing device comprising:

(1) a module configured to receive presynthesized slot information as part of a synchronization process with a computing device, wherein said slot information represents a value of a defined data type in a user record on said computing device, said slot information being designed for inclusion at a predefined position within a carrier phrase;

(2) a module configured to store the presynthesized slot information in a memory; and (3) a module configured to reproduce the carrier phrase and die presynthesized slot information as audible output for a user.

8. The computing device of claim 7, wherein the slot information is one of a name, number, and location.

9. The computing device of claim 7, further comprising a module configured to receive a presynthesized carrier phrase.

10. The computing device of claim 7, wherein the carrier phrase and the presynthesized slot information are compressed and wherein the module configured to reproduce further passes the carrier phrase and the presynthesized slot information through a codec.

11. The computing device of claim 7, wherein the module configured to receive further receives slot information via a wired link.

12. The computing device of claim 7, wherein the module configured to receive receives slot information via a wireless link.

13. A computer-readable medium storing instructions for controlling a portable computing device to synthesize speech, the instructions comprising:

(1) receiving presynthesized slot information as part of a synchronization process with a computing device, wherein said slot information represents a value of a defined data type in a user record on said computing device, said slot information being designed for inclusion at a predefined position within a carrier phrase;

(2) storing said presynthesized slot information in a memory; and (3) reproducing said carrier phrase and said presynthesized slot information as audible output for a user.

14. The computer-readable medium of claim 13, wherein the slot information is one of a name, number, and location.

15. The computer-readable medium of claim 13, further comprising receiving a presynthesized carrier phrase.

16. The computer-readable medium of claim 13, wherein the carrier phrase and the presynthesized slot information are compressed and wherein the reproducing comprises passing the carrier phrase and the presynthesized slot information through a codec.

17. The computer-readable medium of claim 13, wherein the receiving presynthesized slot information further comprises receiving slot information via a wired link.

18. The computer-readable medium of claim 13, wherein the receiving presynthesized slot information further comprises receiving slot information via a wireless link.

19. A system for synthesizing speech on a portable device, the system comprising:

(1) means for receiving presynthesized slot information as part of a synchronization process with a computing device, wherein the slot information represents a value of a defined data type in a user record on the computing device, the slot information being designed for inclusion at a predefined position within a carrier phrase;

(2) means for storing the presynthesized slot information in a memory; and (3) means for reproducing the carrier phrase and the presynthesized slot information as audible output for a user.

20. The system of claim 19, wherein the slot information is one of a name, number, and location.

21. The system of claim 19, further comprising means for receiving a presynthesized carrier phrase.

22. The system of claim 19, wherein the carrier phrase and the presynthesized slot information is compressed and wherein the reproducing comprises passing the carrier phrase and the presynthesized slot information through a codec.

23. The system of claim 19, wherein the means for receiving presynthesized slot information further receives slot information via a wired link.

24. The system of claim 19, wherein the means for receiving presynthesized slot information further receives slot information via a wireless link.

* * * * *

UNITED STATES PATENT AND TRADEMARK OFFICE

CERTIFICATE OF CORRECTION

PATENT NO. : 7,013,282 B2
APPLICATION NO. : 10/742853
DATED : March 14, 2006
INVENTOR(S) : Horst Juergen Schroeter It is certified that error appears in the above-identified patent and that said Letters Patent is hereby corrected as shown below:

At Item (12), the Inventor's last name, "Schrocter" should be --Schroeter--.

Signed and Sealed this

Eighth Day of August, 2006

JON W. DUDAS
*Director of the United States Patent and Trademark Office*